US006886910B2

(12) United States Patent
Baumer

(10) Patent No.: US 6,886,910 B2
(45) Date of Patent: May 3, 2005

(54) CORRECTING STIMULATION NONUNIFORMITY AT THE FLUID CAVITY TRENCH END BOUNDARY

(75) Inventor: Michael F. Baumer, Dayton, OH (US)

(73) Assignee: Eastman Kodak Company, Rochester, NY (US)

( * ) Notice: Subject to any disclaimer, the term of this patent is extended or adjusted under 35 U.S.C. 154(b) by 250 days.

(21) Appl. No.: 10/137,496

(22) Filed: May 2, 2002

(65) Prior Publication Data

US 2003/0206213 A1 Nov. 6, 2003

(51) Int. Cl.[7] ..... B41J 2/15
(52) U.S. Cl. ..... 347/40; 347/12
(58) Field of Search ..... 347/40, 12, 48, 347/49

*Primary Examiner*—Lamson D Nguyen
(74) *Attorney, Agent, or Firm*—Barbara Joan Haushalter

(57) ABSTRACT

In a drop generator for use in an ink jet printer, stimulation transducers are bonded near the ends of the jet array on the droplet generator body. The transducers are electrically controlled with an oscillating voltage signal which can be modified in amplitude and phase with respect to the main driving signal. By altering the drive signal of the end transducers in amplitude and/or phase, the end sections being aligned with the solid end sections of the droplet generator, it is possible to match the vibration of the end sections with the central portion of the droplet generator. The result is more uniform stimulation down the length of the droplet generator.

11 Claims, 5 Drawing Sheets

CORRECTING STIMULATION NONUNIFORMITY AT THE FLUID CAVITY TRENCH END BOUNDARY

TECHNICAL FIELD

The present invention relates to continuous ink jet printers and more particularly to improved constructions for stimulating synchronous drop break-up of the ink jets issuing from elongated arrays of orifices in such printers.

BACKGROUND ART

In continuous ink jet printing, ink is supplied under pressure to a manifold that distributes the ink to a plurality of orifices, typically arranged in linear array(s). The ink is expelled from the orifices in jets which break up due to surface tension in the ink into droplet streams. Ink jet printing is accomplished with these droplet streams by selectively charging and deflecting some droplets from their normal trajectories. The deflected or undeflected droplets are caught and re-circulated and the others are allowed to impinge on a printing surface.

To selectively charge the ink droplets, it is desirable to stimulate the ink jets to accurately control the locations that the droplets separate from the ink jets downstream from the orifice plate. Such stimulation is provided by applying a vibration to the ink, for example, by vibrating the orifice plate. Stimulation also maintains uniform drop size and drop spacing as well as controlling the location of the drop separation. It is also desirable that the droplets from all of the jets separate at the same time from their respective jets, an occurrence known as synchronous stimulation. Such synchronous stimulation simplifies the problem of drop charging, since each drop in the jet separates from the jet at a precisely predictable time period, allowing accurate drop charging and placement and avoiding printing errors due to improper droplet charging.

One problem which occurs on all droplet generators is that the motion and hence the stimulation at the boundary defined by the end of the droplet generator fluid cavity trench and the end of the orifice plate array is not the same as in the middle of the droplet generator. This leads to nonuniform break off of the jets near the ends of the array.

One known method of increasing the uniformity of break off of the jets along the entire length of the droplet generator is described in U.S. Pat. No. 4,999,647. When the orifice array is made longer than, for example 10 cm, the printhead has many other modes near 50 kHz which must be suppressed for proper operation of the printhead. The '647 patent discloses an ink jet printhead having a series of slots through the printhead body to divide the body into a plurality of approximately identical dilatational regions. These slots have the effect of decreasing the mode coupling between the desired vibrational mode necessary for synchronous stimulation and undesired modes that decrease efficiency and frustrate synchronous stimulation. As printing speeds are increased, it becomes desirable to stimulate the ink jets at increasingly higher frequencies.

It has been found, however, that print heads of the type shown in the '647 patent cannot be synchronously stimulated much above 100 kHz before mode coupling again becomes a serious problem. At such high frequencies, mode coupling occurs not only in the print head itself, but also in the piezoelectric transducers employed to drive the print head.

An alternate drop generator design for long array, high frequency applications is described in commonly assigned, co-pending U.S. patent application Ser. No. 09/211,059, totally incorporated herein by reference. The drop generator described therein utilized multi-lobed radial vibrational modes to stimulation the array of jets. It was recognized in that application that the vibration of the ends of the drop generator tends to be different than in the middle of the array. By making cuts into the top of the drop generator parallel to its long axis, the ends of the drop generator can be made to vibrate more like the center of the drop generator. It has been found however that while the cut parallel to the array on the top of the drop generator improved stimulation uniformity, that further improvements in stimulation uniformity are desirable.

It would be desirable, therefore, to improve nonuniformity of jet stimulation at the end area regions of the orifice plate array, particularly when operating at high frequencies.

SUMMARY OF THE INVENTION

The present invention provides for correction of stimulation nonuniformity at the fluid cavity trench end boundaries by changing the motion of the droplet generator body in a local area near the end area regions of the orifice array. This either enhances or modifies the normal motion of the body to give improved stimulation at the end area regions of the orifice array.

In accordance with one aspect of the present invention, stimulation transducers are bonded near the ends of the jet array on the droplet generator body which extends close to the end of the orifice array. The transducer is electrically controlled with an oscillating voltage signal which can be modified in amplitude and phase with respect to the main driving signal. Piezoelectric transducers cause the droplet generator cross section to flex. The solid material which defines the end of the cavity has a change in rigidity due to not having the fluid cavity trench, which changes the cross sectional flexing of the end portions of the droplet generator compared to the middle of the droplet generator. As a result, the ends of the droplet generator will tend to vibrate at a different amplitude and phase from the rest of the structure. As the ends of the droplet generator are coupled to the rest of the structure, this nonuniform vibration of the end sections can affect the vibration along the length of the structure, but most significantly near the ends of the cavity. By altering the drive signal of the end section transducers in amplitude and/or phase, the end sections being aligned with the solid end sections of the droplet generator, it is possible to match the vibration of the end sections with the central portion of the droplet generator. The result is more uniform stimulation down the length of the droplet generator. The transducers can be used in conjunction with an acoustic cut fabricated into the droplet generator body.

Other objects and advantages of the invention will be apparent from the following description and the appended claims.

DETAILED DESCRIPTION OF THE INVENTION

The present invention discloses a technique for correcting stimulation nonuniformity at the fluid cavity trench end boundary by changing the motion of the drop generator body in a local area near the end area regions of the orifice array such that the normal motion of the body is either enhanced or modified to give improved stimulation at the end area regions of the orifice array. Stimulation transducers are bonded near the ends of the jet array on the droplet generator body, and the transducers are driven at a different amplitude and phase than the rest of the driving transducers.

Altering the amplitude and/or phase of the drive signal of the end transducers allows for matching of the vibration of the end sections with the central portion of the droplet generator. Once the phase shift and amplitude adjustment are set in production, no changes in these two parameters are needed. The print head operator therefore has no need to change these parameters. The result is a more uniform stimulation down the length of the droplet generator.

Figure 1:
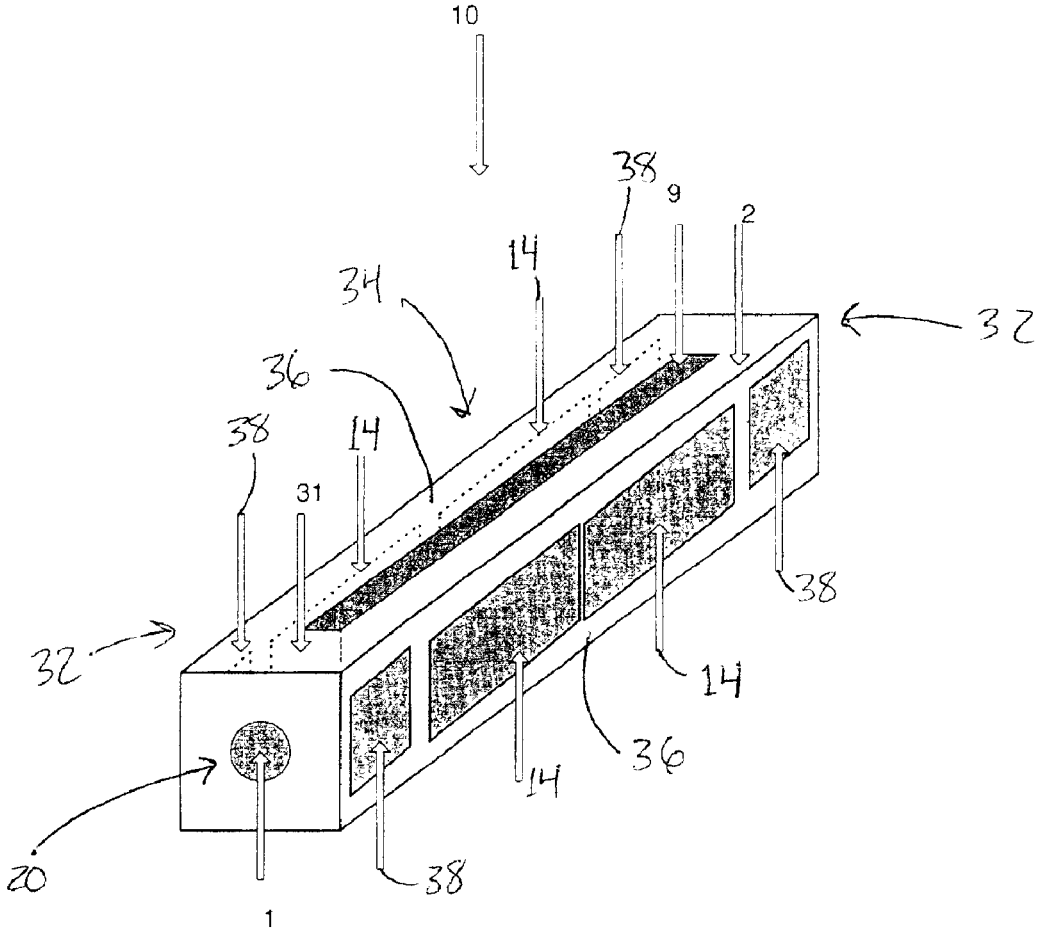
FIG. 1 is a perspective view of an ink jet print head in accordance with the present invention.
Figure 2:
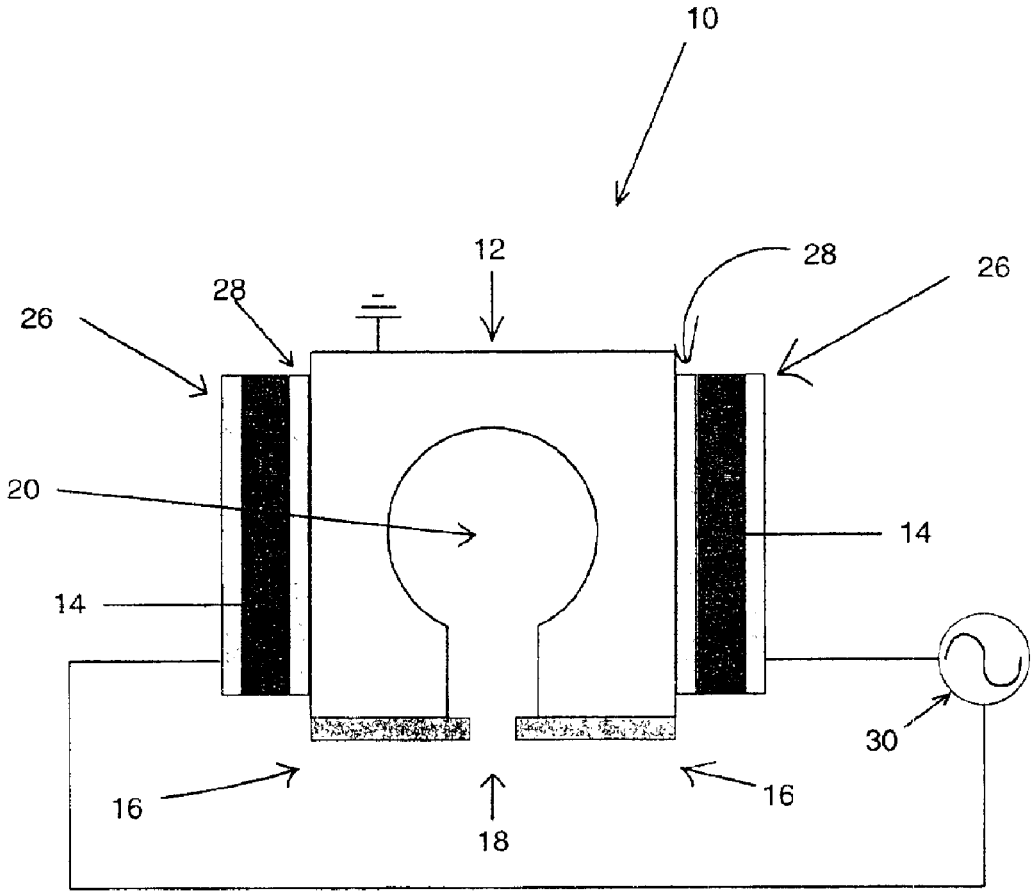
FIG. 2 is a cross-sectional view of the ink jet printhead of FIG. 1.

Referring now to the drawings, FIG. 1 shows a perspective view of an existing droplet generator 10. The drop generator has a through bore 20 extending from a fluid inlet port 1 and a fluid outlet port 2. A fluid cavity trench 9 is machined in to the orifice plate bonding surface to connect with the through bore 20. This fluid cavity trench extends down much of the length of the drop generator. A fluid cavity trench 9 conducts ink from the through bore 20 to the orifices of an orifice plate 16, as shown in FIG. 2, that is bonded to the orifice plate bonding surface 31. Piezoelectric transducers 14 are bonded to the sides of the drop generator along each side of the fluid cavity trench. A stimulation drive circuit, not shown, is used to drive these piezoelectric transducers 14. These piezoelectric transducers, which can be poled for either shear mode or thickness mode operation, cause the sides of the fluid cavity to flex to provide the necessary stimulation of the ink jetting from the orifice plate.

Along the length of the fluid cavity trench 9, a uniform vibration amplitude and phase can be produced by uniformly driving the piezoelectric transducers 14. Near the ends of the drop generator, however, the fluid cavity trench 9 must terminate, to keep ink from spraying out the ends of the drop generator. As a result, the cross section of the drop generator at each end of the body does not match the cross section in the middle of the body. The vibration of the end area regions 32 of the drop generator, beyond each end of the fluid cavity trench 9, therefore does not match that of the central portion 34 of the drop generator. The mismatch in vibration between the central portion 34 of the drop generator and the end regions 32 of the drop generator can result in a large phase shift in the drop break off from the jets near each end array relative to the other jets.

U.S. application Ser. No. 09/211,059 described slots cut into end regions of the drop generator. These slots in the top surface of the drop generator are parallel to the fluid cavity trench. The slots serve to reduce the mismatch between the end regions of the drop generator and the central portion of the drop generator. It has been found, however, that while these slots are useful in reducing the mismatch, some mismatch still exists, resulting in a break off phase shift for the jets at each end of the orifice array.

The present invention provides a means to reduce the mismatch between the end regions 32 of the drop generator 10 and the central portion 34 of the drop generator 10. In accordance with the present invention, one or more piezoelectric transducers 14 are attached to sides of the central portion 34 of the droplet generator, adjacent to each side 36 of the fluid cavity 9. In addition to these piezoelectric transducers, at least one piezoelectric transducer 38 is attached to the sides of the drop generator in each end region 32 of the drop generator. According to the present invention, the stimulation uniformity can be improved by changing the vibrational drive amplitude and/or phase of the end region 32 piezoelectric transducers 38, relative to that of the central portion 34 piezoelectric transducers 14.

One means to change the vibrational drive amplitude and/or phase of the end region piezoelectric transducers is to employ a stimulation drive circuit (not shown) which can supply drive signals of different amplitude and/or phase to the various end region piezoelectric transducers 38.

In one preferred embodiment, the drive voltage of the end region transducers 38 is typically adjusted to an amplitude of 0.5 to 1.5 times that of the central region transducers 14. The phase of the drive signal for the end region transducers 38 is typically adjusted to lead or lag that of the central portion transducers by up to 45°. Altering the amplitude and/or phase of the drive signal of the end region piezoelectric transducers allows for matching of the vibration of the end sections with the central portion of the droplet generator. Once the phase shift and amplitude adjustment are set in production, no changes in these two parameters are needed. The print head operator therefore has no need to change these parameters. The result is a more uniform stimulation down the length of the droplet generator.

It is of note that the present invention only requires changing the amplitude and/or phase of the end region transducers 38. In the present invention, the transducers are securely bonded to the drop generator body. The drop generator body provides significant coupling between all the transducers. Therefore it is not necessary to provide means to adjust the amplitude of the drive signals for the central portion transducers 14. In particular, all the transducers in the central portion of the drop generator can have a common drive amplitude. The present invention only requires a separate drive signal to be supplied to the end region transducers to allow their amplitude and/or phase to be shifted relative to that of the central portion transducers.

Figure 4:
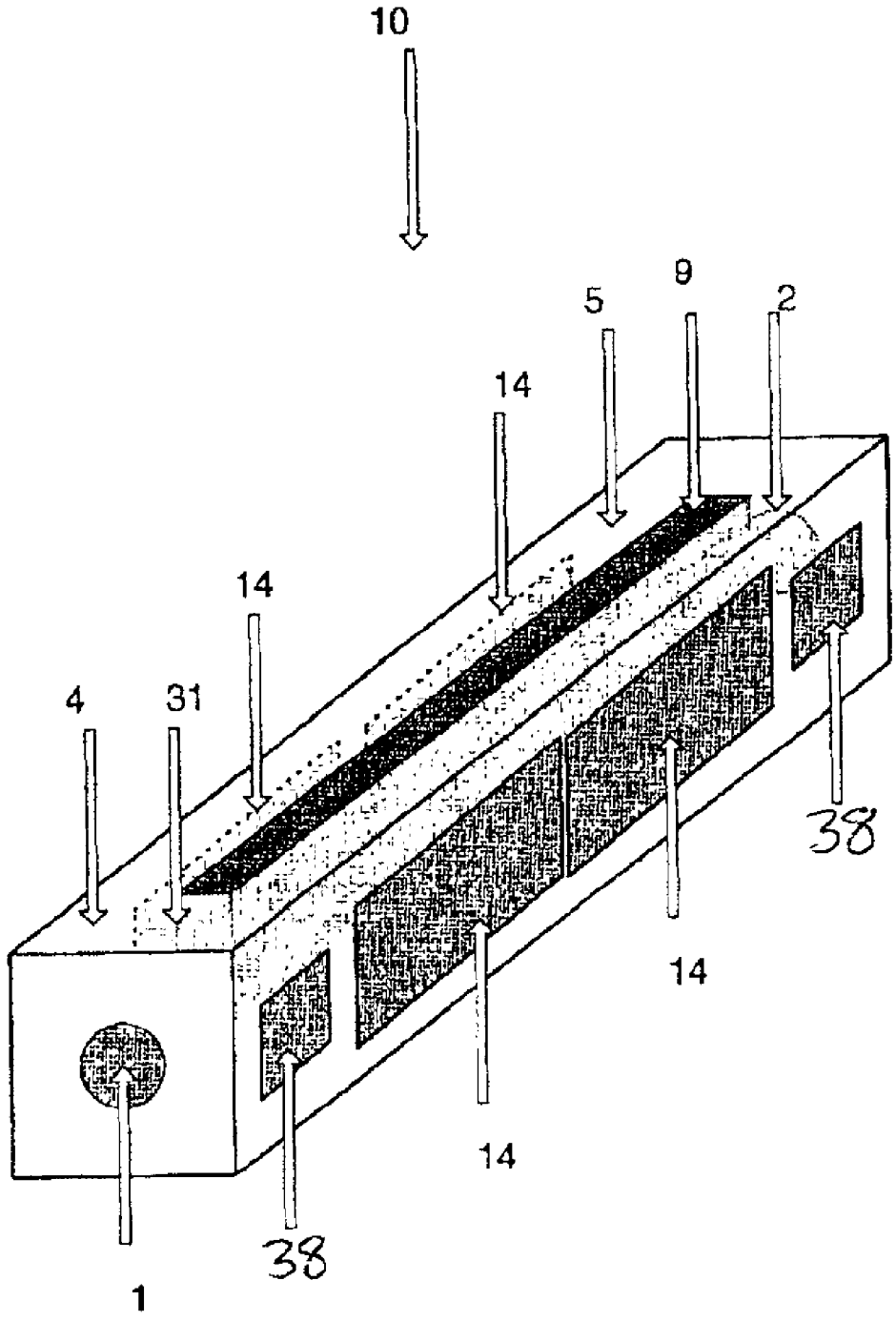

In an alternate embodiment, the means to change the drive amplitude of the end region transducers 38 comprises changing the drive efficiency of the end region transducers relative to that of the central portion transducers 14. One method of accomplishing this is by using piezoelectric transducers with different thicknesses or heights than that of the transducers in the central region of the drop generator, with the height being measured perpendicular to the long axis of the drop generator. FIG. 4 shows such an embodiment, wherein the height of the end region transducers 38 has been reduced relative to that of the central portion transducers 14. By way of example, if the end region and the central portion transducers are poled for operating in the thickness mode, and are all approximately 0.020 inch thick, the height of the end region transducers, can be changed to between 0.16 and 0.18 inch. This adjusted height is compared to a height of 0.20 inch for the central portion transducers. Such an adjustment can provide a significant improvement in stimulation uniformity.

Figure 5:
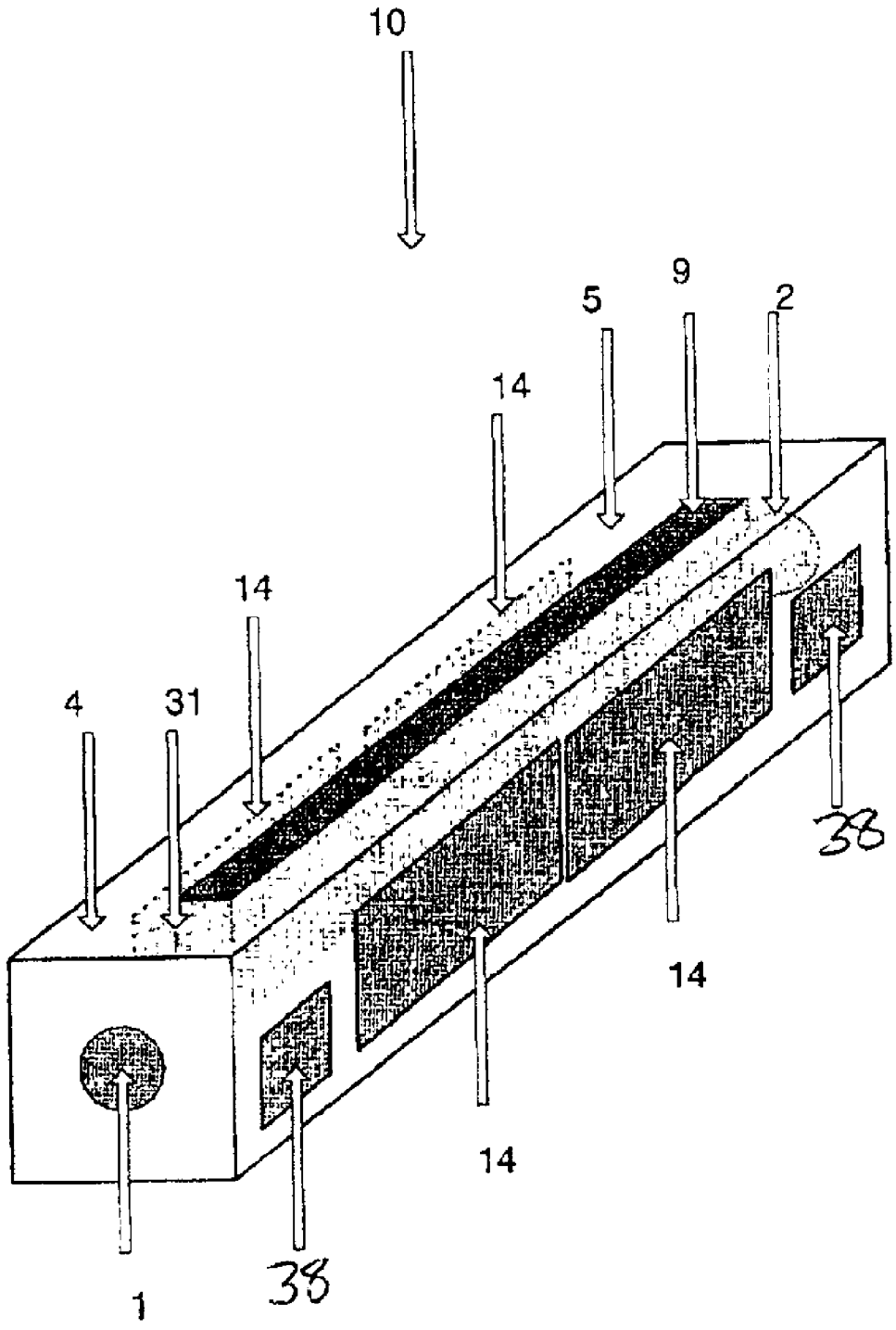

Alternatively, or in conjunction therewith, the drive efficiency of the end region transducers can be changed by shifting the vertical placement of the end region transducers on the side of the drop generator relative to that of the central portion transducers. FIG. 5 illustrates an embodiment wherein the end region transducers have a reduced height and have been shifted vertically so that the center of the end region transducers is no longer aligned with the center of the end region transducers. A vertical placement shift of the end region transducer denotes that the end region transducer location has been shifted perpendicular to a long axis of the drop generator relative to a location of the at least one central portion stimulation transducer.

Figure 3:
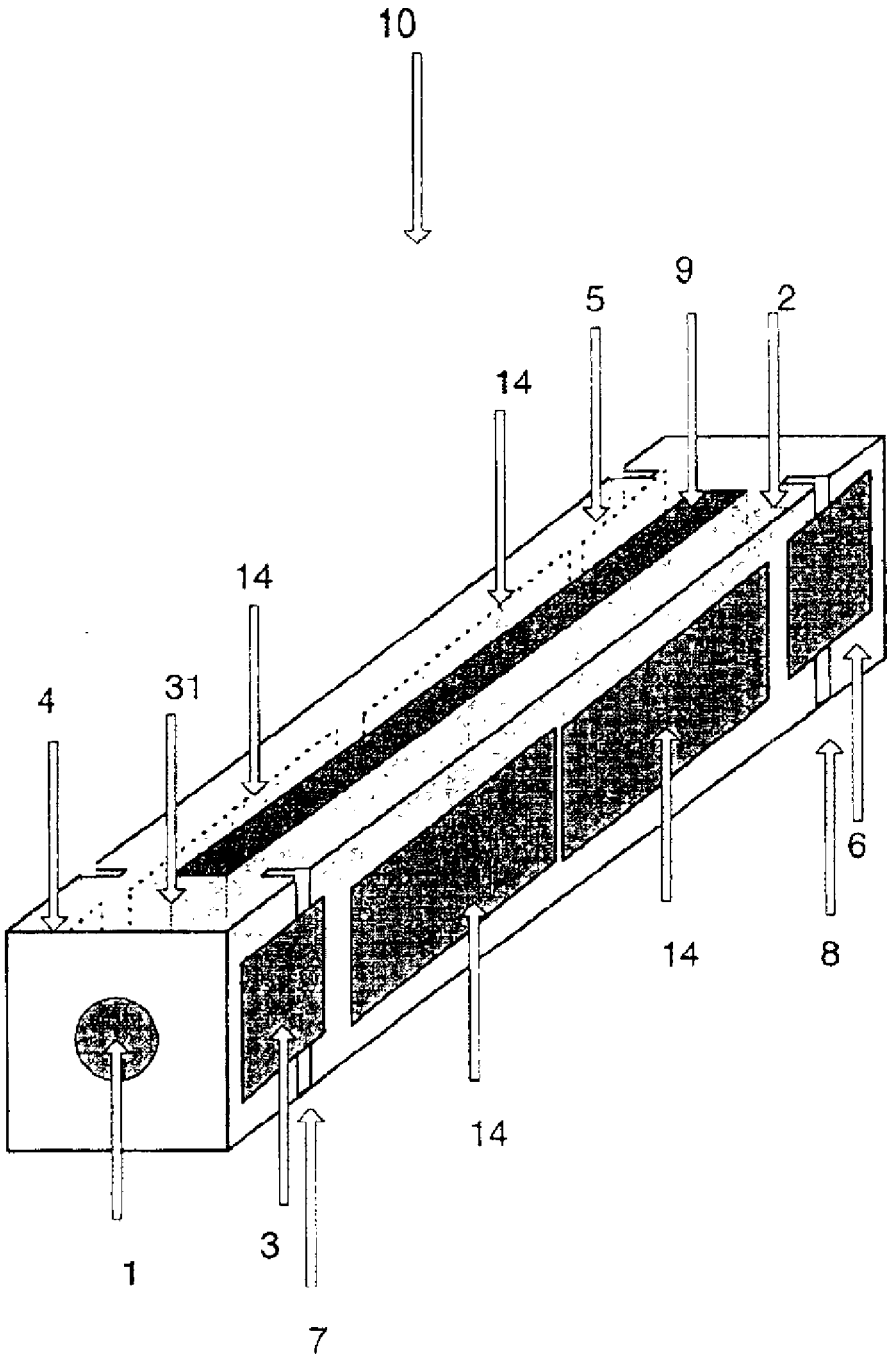
FIGS. 3-5 are perspective views of alternative embodiments of a printhead constructed in accordance with the present invention.

In yet another alternative embodiment of the present invention, acoustic cuts in the droplet generator can be used, in conjunction with the transducer adjustments taught herein. FIG. 3 shows the piezoelectric transducers as shown in FIG. 1, incorporating acoustic end cuts 7,8. The acoustic cuts are made in the faces of the drop generator to which the piezoelectric transducers are bonded. These cuts, which are made perpendicular to the axis of the ink jet array, are aligned substantially with the end of the fluid cavity trench to separate the motion of the end of the droplet generator from the central portion of the droplet generator.

In one preferred embodiment, these acoustic cuts are 0.015 inch wide, 0.100 inch deep and are the height of the drop generator. Since the cuts are not made completely through the part, there is still some motion transferred from the end to the trench area of the droplet generator and this can be compensated for by modifying the electrical signals to the end transducers.

The invention has been described in detail with particular reference to certain preferred embodiments thereof, but it will be understood that modifications and variations can be effected within the spirit and scope of the invention.

What is claimed is:

1. A method for correcting stimulation nonuniformity at end area regions of an orifice plate of a droplet generator body, the orifice plate having an array of jets, the droplet generator body having end regions and a central portion, and further having at least one central portion stimulation transducer bonded to the central portion of the droplet generator adjacent to a fluid cavity trench, the method comprising the steps of:

bonding at least one end region stimulation transducer in each end region of the droplet generator beyond ends of the fluid cavity trench;

using the at least one end region stimulation transducer to drive the end regions of the droplet generator at an amplitude and/or phase different from the amplitude and phase provided by the at least one central portion stimulation transducer; and fabricating at least one acoustic cut in the droplet generator body.

2. A method as claimed in claim 1 wherein the step of using the at least one end region stimulation transducer to drive the end regions of the droplet generator comprises the step of supplying the drive signal to the at least one end region stimulation transducer at a different amplitude or phase from a drive signal supplied to the at least one central portion stimulation transducer.

3. A method as claimed in claim 2 wherein the step of using the at least one end region stimulation transducer to drive the end regions of the droplet generator comprises the step of changing the drive efficiency of the at least one end region stimulation transducer relative to that of the at least one central portion stimulation transducer.

4. A method as claimed in claim 1 further comprising the step of using the at least one end region stimulation transducer in conjunction with the at least one acoustic cut.

5. In a droplet generator body having first and second end sections with a fluid cavity to which an orifice plate with an orifice plate face is bonded, the orifice plate having an array of jets, a method for modifying motion of the droplet generator body in a region near the first and second end sections, the method comprising the steps of:

bonding at least one end section stimulation transducer at each of the first and second end sections of the droplet generator body;

electrically controlling the at least one end section stimulation transducer with an oscillating voltage signal which can be modified in amplitude and phase with respect to a main driving signal; and fabricating at least one acoustic cut in the droplet generator body.

6. A method as claimed in claim 5 further comprising the step of using the at least one end section stimulation transducer in conjunction with the at least one acoustic cut.

7. A drop generator for use in an ink jet printer, the drop generator having first and second end sections and a fluid cavity to which an orifice plate is bonded, the orifice plate having an array of jets, the drop generator comprising:

a plurality of central portion transducers driven at a given amplitude and phase;

at least one end region stimulation transducer bonded to a region of each of the first and second end sections of the droplet generator body;

means for electrically controlling the at least one end region stimulation transducer with an oscillating voltage signal which can be modified in amplitude and phase with respect to the plurality of driving transducers; and at least one acoustic cut fabricated in the droplet generator body.

8. A drop generator as claimed in claim 7 further comprising means for using the at least one end region stimulation transducer in conjunction with the at least one acoustic cut.

9. A drop generator for use in an ink jet printer, the drop generator having a central portion bounded by first and second end sections and a fluid cavity to which an orifice plate is bonded, the orifice plate having an array of jets, the drop generator comprising:

at least one central portion transducer to induce vibration in the central portion of the drop generator;

at least one end region transducer for inducing vibration in the first and second end sections of the drop generator; and means for altering the drive efficiency of the least one end region transducer relative to the at least one central portion transducer, by locating the at least one end region transducer at a location that is shifted perpendicular to a long axis of the drop generator relative to a location of the at least one central portion transducer.

10. A drop generator as claimed in claim 9 wherein the means for altering the drive efficiency of the least one end region transducer comprises means for providing at least one end region stimulation transducer having a width different than a width of the at least one central portion transducer.

11. A drop generator as claimed in claim 9 wherein the means for altering the drive efficiency of the least one end region transducer comprises means for providing at least one end region stimulation transducer having a thickness different than a thickness of the at least one central portion transducer.

* * * * *